US009499327B2

(12) United States Patent
D'Amato

(10) Patent No.: US 9,499,327 B2
(45) Date of Patent: Nov. 22, 2016

(54) CONICAL CONTAINER

(71) Applicant: Seda International Packaging Group SpA, Naples (IT)

(72) Inventor: Gianfranco D'Amato, Naples (IT)

(73) Assignee: Seda International Packaging Group SpA, Naples (IT)

( * ) Notice: Subject to any disclaimer, the term of this patent is extended or adjusted under 35 U.S.C. 154(b) by 0 days.

(21) Appl. No.: 14/646,210

(22) PCT Filed: Nov. 28, 2013

(86) PCT No.: PCT/EP2013/003596
§ 371 (c)(1),
(2) Date: May 20, 2015

(87) PCT Pub. No.: WO2014/082747
PCT Pub. Date: Jun. 5, 2014

(65) Prior Publication Data

US 2015/0314944 A1 Nov. 5, 2015

(30) Foreign Application Priority Data

Nov. 29, 2012 (DE) ..... 20 2012 011 488 U

(51) Int. Cl.

| | |
|---|---|
| ***B65D 3/22*** | (2006.01) |
| ***B65D 3/28*** | (2006.01) |
| ***A47G 19/22*** | (2006.01) |
| ***B65D 81/38*** | (2006.01) |
| ***B65D 3/06*** | (2006.01) |

(52) U.S. Cl.
CPC ..... *B65D 81/3874* (2013.01); *A47G 19/2205* (2013.01); *B65D 3/06* (2013.01); *B65D 3/22* (2013.01); *B65D 3/28* (2013.01)

(58) Field of Classification Search
CPC ..... A47G 19/2205; A47G 19/2288; B65D 3/22; B65D 3/28; B65D 81/3874; B65D 81/3865
USPC ..... 229/403; 220/669–272
See application file for complete search history.

(56) References Cited

U.S. PATENT DOCUMENTS

| | | | | |
|---|---|---|---|---|
| 2,028,566 A * | 1/1936 | Seipel | A47G 23/0216 220/737 |
| 3,921,889 A | 11/1975 | Gibbons | |
| RE33,608 E * | 6/1991 | Sorensen | B29C 45/36 206/519 |
| 6,588,654 B2 * | 7/2003 | Nakashima | B31B 17/00 229/117.12 |

(Continued)

FOREIGN PATENT DOCUMENTS

| | | |
|---|---|---|
| DE | 102009026108 A1 | 1/2011 |
| DE | 202010003401 U1 | 9/2011 |

(Continued)

OTHER PUBLICATIONS

International Search Report for PCT/EP2013/003596. 2 pages.
German Search Report for 202012011488.3 dated Jul. 16, 2013. 5 pages.

*Primary Examiner* — Gary Elkins
(74) *Attorney, Agent, or Firm* — Fish & Richardson P.C.

(57) ABSTRACT

The invention provides a conical container (1) with a bottom (2) and a perimetral wall (3) which is preferably made out of a single layer of cardboard. The perimetral wall has annular projections (11), which are formed by overlapping portions (13,15) of the perimetral wall and which are extending approximately parallel to the perimetral wall.

10 Claims, 4 Drawing Sheets

(56) References Cited

U.S. PATENT DOCUMENTS

Figure 1:
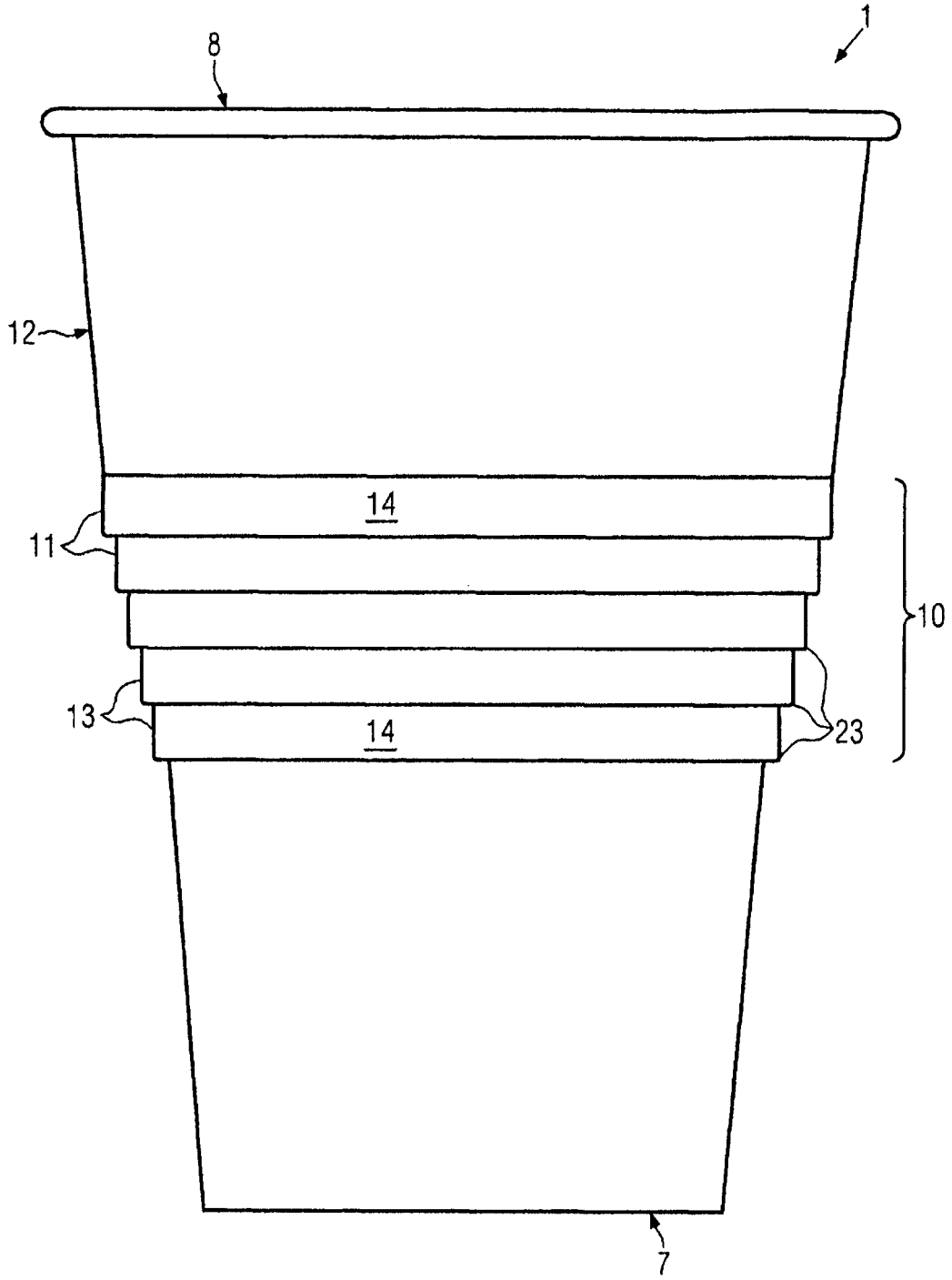

| | | | | |
|---|---|---|---|---|
| 9,045,246 | B2 * | 6/2015 | Nishida | B65D 5/24 |
| 2012/0012647 | A1 * | 1/2012 | Almabekov | B65D 81/3876 229/400 |
| 2012/0104004 | A1 * | 5/2012 | Marshall | B31B 1/25 220/660 |
| 2013/0140211 | A1 * | 6/2013 | Robbins, III | A45F 3/20 206/517 |

FOREIGN PATENT DOCUMENTS

| | | | | | |
|---|---|---|---|---|---|
| GB | 1073796 | A | | 12/1963 | |
| GB | 1366310 | A | * | 9/1974 | A47G 19/2288 |
| GB | 2061699 | A | | 5/1981 | |
| GB | 2130471 | A | | 6/1984 | |
| JP | H06-144434 | A | | 5/1994 | |
| JP | 2006-160346 | A | | 6/2006 | |
| JP | 313535 | U | | 9/2007 | |

* cited by examiner

CONICAL CONTAINER

CROSS-REFERENCE TO PRIOR APPLICATION

This is the U.S. National Phase Application under 35 U.S.C. §371 of International Patent Application No. PCT/EP2013/003596 filed Nov. 28, 2013, which claims the benefit of German Patent Application No. 20 2012 011 488.3 filed Nov. 29, 2012, both of them are incorporated by reference herein. The International Application was published in English on Jun. 5, 2014 as WO2014/082747 A1 under PCT Article 21(3).

The invention relates to a conical container having a bottom wall and a single perimetral wall with at least one annular projection.

A container of this type is known for GB 1 073 796. The container is made of plastic and is produced by a molding process providing thin walls and projections, which are extending from the container wall as horizontal fins. Such containers may be nestable. In some embodiments, the fins are used in order to provide a support for the stacking. The fins are made from the container wall, which in the area of the fins is bent outwardly and may be joined together to provide a rigid horizontal rim.

In the introduction part of the patent GB 1 073 796 it is claimed that paper cups have many inherent drawbacks. In that regard "moisture absorption" and "vapor transmission" are mentioned. Furthermore, the existence of a seam in paper cups is criticized because it requires glue or any adhesive in order to close the wall. Also the weakness in the structure is mentioned. As a consequence, in the prior art, use of plastic is proposed in order to produce insulated cups for the consumption of hot beverages, such as coffee.

It is an object of the invention to propose a single wall container which, on the one hand, is well insulated and provides a stiff construction of the wall and, on the other hand, provides some variability with respect to its size and use. This object is solved by the characterizing part of the main claim.

The container of the invention is made of cardboard, which combines the advantages of a low cost production with a possibility of recyclability. The cardboard may be laminated on the inside in order to make the container wall watertight. The same may happen on the outside of the container.

The projections are formed as folds of the cardboard wall. Such folds are providing a good insulation against the transfer of heat from the interior of the cup. Additionally, they make the cup sturdy and stiff, which is especially important if a container is filled with contents, the temperature of which being largely different from the temperature of the hand of the user. This is especially true for hot beverages, but also for cold contents as, for example, ice cream.

The folds are directed more or less parallely to the container wall, thus enlarging the insulated area of the outside wall. In the range of the fold the cardboard is consisting of three layers of the container wall because each fold is consisting of two bendings of the material. In the overlapping area the insulation is considerably better as one of the single cardboard wall.

Cardboard is usually provided with a liner in order to make it watertight. If this liner is consisting of a heat sealable material, the liner may also be used in order to partially or totally connect the different layers of the fold together.

If the container of the invention is made of paper, carton or any other comparable material, the production of the folds is not by molding, but by a bending of the materials. This allows a certain variability in terms of the size and shape of the container and of the use thereof.

Basically, it is possible to use a standard cup and apply a different number of folds in order to produce various cup sizes, like 10 ounces, 12 ounces etc., from this standard cup. The use of one standard cup for various final products lowers the costs of production.

Furthermore, it is, of course, possible to vary the number of folds in order to determine a specific holding range. Such a variation may be used in order to adapt the cup of the invention to cup holders of cars. Such cup holders are not standardized and, therefore, the cup of the invention may be adapted to various sizes of such cup holders. The fact that the folds are approximately parallel to the perimetral wall may allow the insertion of the container of the invention into different cup holders because folds are not preventing the integration.

In a further embodiment of the invention, a plurality of folds are arranged one above the other, whereby each higher fold has a larger diameter than the lower fold.

In order to limit the heat transfer between the container wall and the user's fingers, it is possible to optimize the height of each said folds in a vertical distance between neighbored folds. The optimum is reached when the user only touches a fold and not the container wall where it is only arranged as a single wall.

Therefore, as a further embodiment, it is proposed that the folds are spaced no further apart than necessary to ensure that a user's fingers primarily touch the outside and/or the edges of each fold and avoid contact with the inter-fold sections of the wall.

In order to improve the stability of the container, it is proposed that at least one portion of the wall in the overlapping region of the folds is connected to at least one another portion of the wall connected, preferably sealed.

In order to avoid that the contents of the container may intrude the fold, it is possible that at least two portions of the container wall are connected to each other at the upper inner end of the fold.

An additional improvement of the watertightness might be given if the fold is connected respectively sealed at the upper end and lower end thereof.

A further improvement of the insulating capacity may be reached if the overlapping fold includes one or two hollow chambers. These chambers may be formed by the neighboring layers of the wall within the overlapping region.

One embodiment of the invention is shown in the drawings. The figures show

Figure 2:
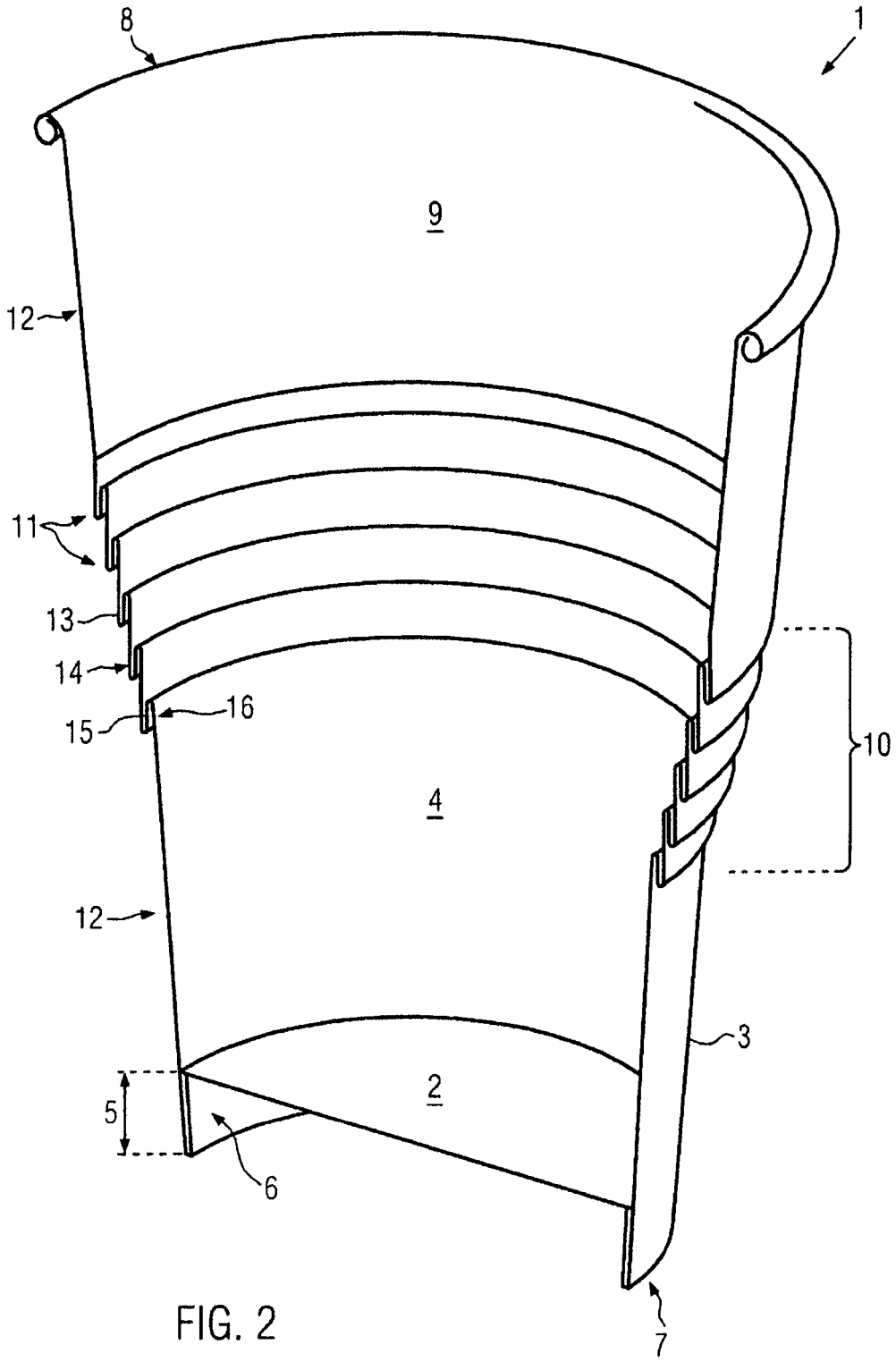
Figures 3, 4:
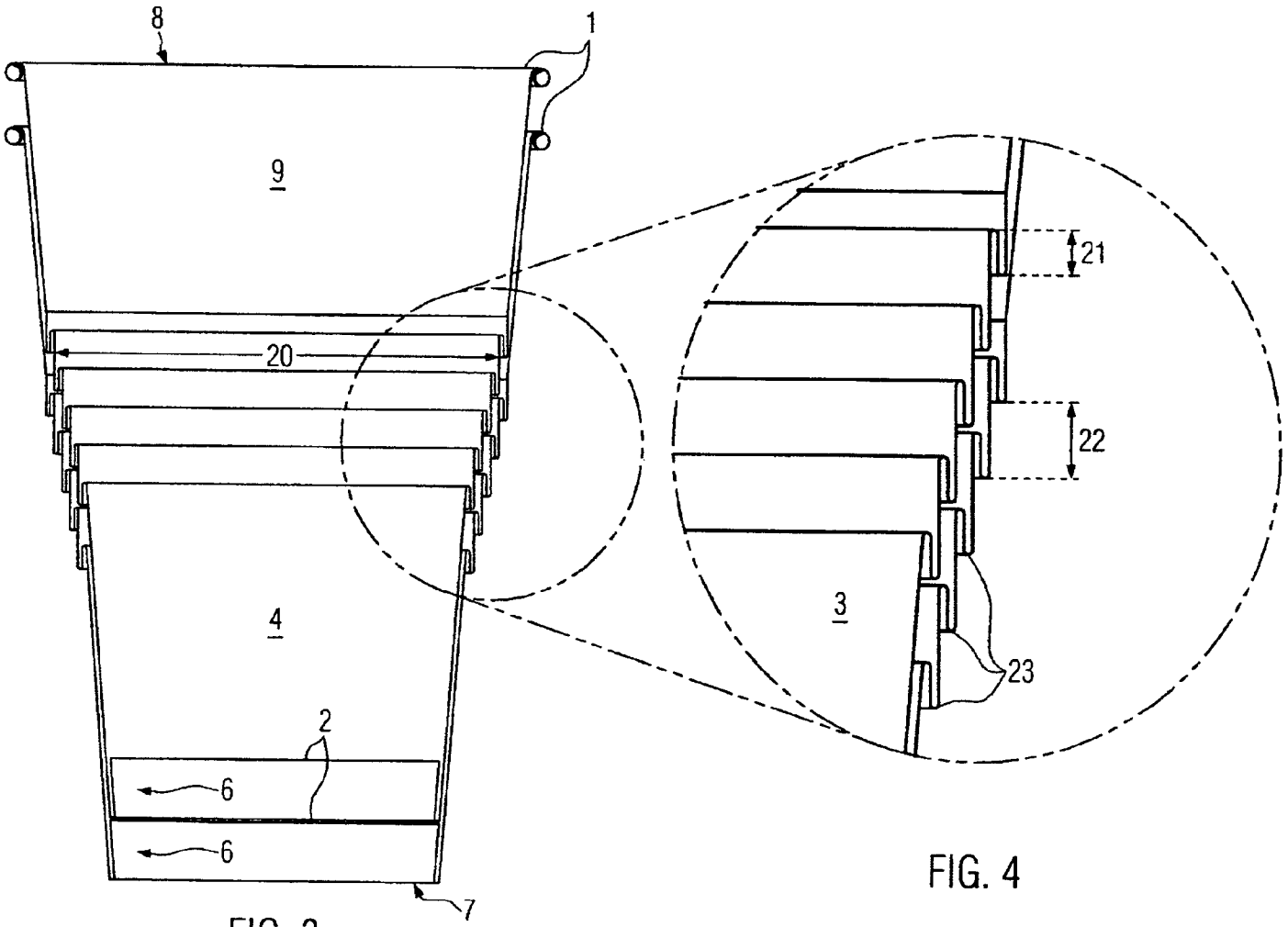
Figure 5:
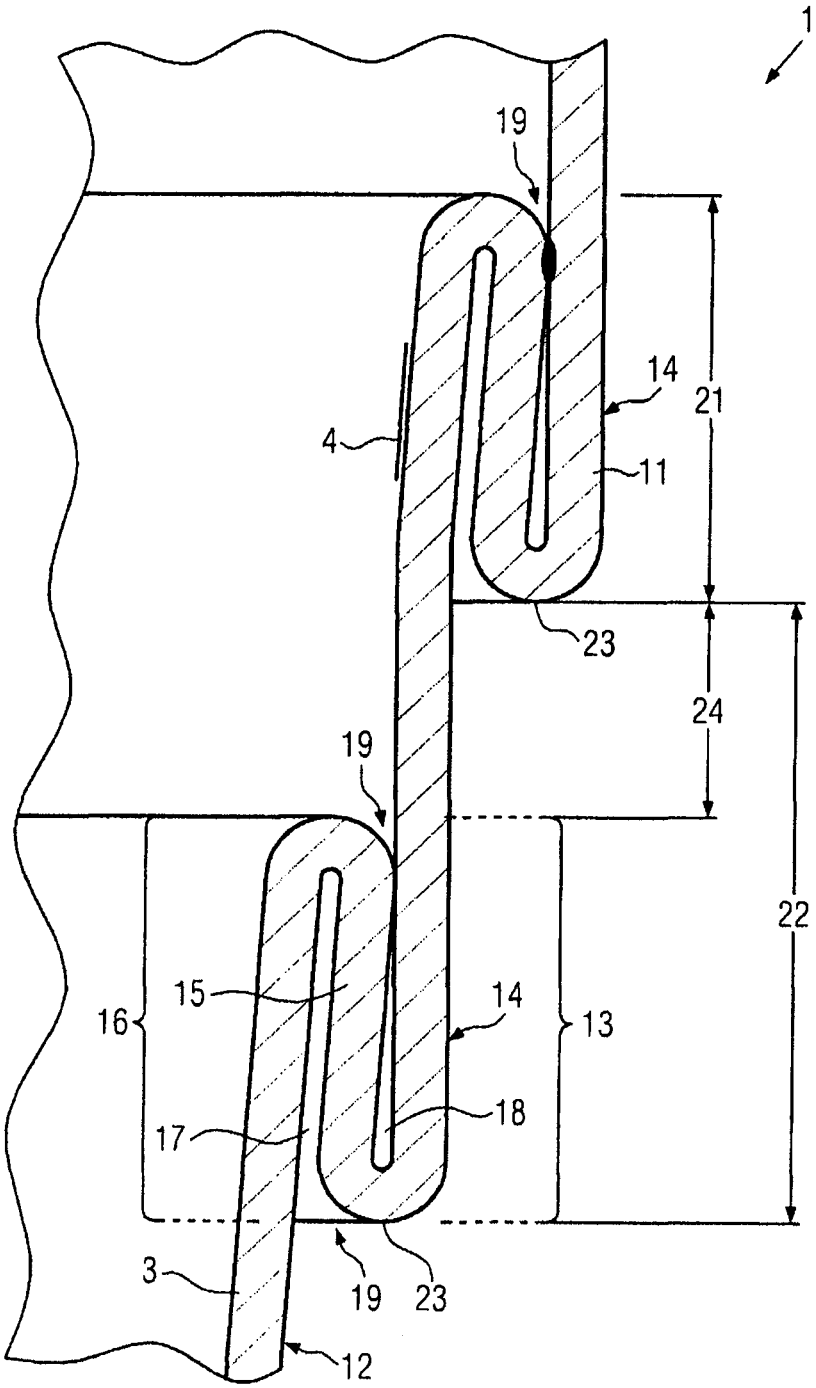

FIG. 1 a side view of the container of the invention,

FIG. 2 a sectional perspective view into the interior of the container of FIG. 1, FIG. 3 a sectional view of a set of two containers of the invention nested in each other, and FIG. 4 an enlarged view on the sidewall of the container n the holding range, and FIG. 5 an enlarged schematic view of two folds.

The container 1 of the invention shows a frusto-conical shape. It provides a bottom 2, which is inserted into a single perimetral container wall 3. The bottom 2 and the container wall 3 are preferably made of a single layer of cardboard, which may show a liner 4 for the purpose of watertightness. The liner 4 may consist of a lamination and is preferably made of a heat sealable material, like polyethylene. The liner 4 might be applied to only one side of the cardboard, for example in order to provide the watertightness for the interior of the container. It is, however, also possible to apply the liner 4 to the outside of the cardboard in order to provide a water resistant layer at the outside of the container.

The bottom 2 is arranged at a distance 5 above the lower rim 7 of the lower portion of the container wall 3. It provides a flange 6, which is preferably parallel to the neighboring container wall 3 and which is used in order to connect the bottom 2 to the container wall 3.

The connection may be made by any type of connection means, preferably by using glue or heat active material. The easiest connection is made by heat sealing, if the liner consists of a heat sealable material.

The lower rim 7 of the container provides a support if the container is standing on a surface. The flange 6 is ending at the same level as the lower rim 7.

At the upper end of the container 1 a rolled-over rim 8 is placed, which surrounds the drinking opening 9 of the container 1. The rim 8 may also act as a holding means for a lid which may be used in order to close the container. Such lid, however, is not shown.

The container 1 provides a holding range 10 within which some annular projections 11 are arranged. As may be seen from FIGS. 1 and 3, the projections are slightly reaching out over inclined outer shape 12 of the container wall and show an approximately vertical outer portion 13.

In the embodiment of the drawing, the container shows in total five projections 11, which are all arranged within the holding range 10.

FIGS. 2, 3 and especially FIG. 5 show the formation of the projections 11. They are each consisting of a fold 14 made by the container wall and comprising of the already mentioned outer portion 13, an intermediate portion 15 and an inner portion 16. As may be seen, the portions 13, 15 and 16 are overlapping each other by forming the fold 14. The fold is extending approximately parallel to the perimetral wall, whereby at least the outer portion 13 may be kept vertical.

Between said portions 13, 15 and 16, chambers 17 and/or 18 may be formed in order to provide a hollow structure which may be closed by connections 19. In these chambers, vacuum may be provided prior to applying the connections or fixations 19 in order to keep the folds tight.

On the other hand, one or both chambers may be filled with gas, for example air, in order to provide a certain distance between the portions 13, 15 and 16. At any rate, the chambers 17 and 18 may be kept open or closed by the mentioned connections and fixations 19.

As may be seen from drawings, the folds 14 are arranged one above the other, whereby each higher fold 14 has a larger diameter 20 than each lower fold.

The height 21 of each fold and the vertical distance 22 between neighbored folds 14 may be optimized in order to limit the heat transfer from the container wall 3 and the user's fingers.

The folds 14 are spaced no further apart than necessary in order to ensure that a user's finger primarily touches the outside portion 13 or even only the edges 23 of each fold 14. This reduces the contact with the inter-fold section 24 of the container wall 3.

The connections or fixations 19 may occur by using a glue or any other fixation means, for example the heat sealable material of the liner 4. It is of course possible to apply both connections 19 in order to shut off the chambers 19 and 18 together from the outside.

As may be seen from FIG. 3, the containers of the invention are nestable to each other whereby the inner container is resting with its lower rim 7 on the upper side of the bottom 2 of the lower container.

The container walls 3 of both nested containers are not touching each other, thereby avoiding friction between the containers and allowing the service personnel of denesting each container separately from the following container with one hand only.

The folds 11 of two stacked containers are neatly superimposed to each other without interfering.

The invention claimed is:

1. A conical container having a bottom wall and a single perimetral wall with annular projections, wherein said perimetral wall is made of cardboard laminated at least on the inside, characterized in that said projections are formed as overlapping folds extending approximately parallel to the perimetral wall, wherein a plurality of said folds are arranged one above the other with an inter-fold section therebetween, each higher fold having a larger diameter than each lower fold and said folds spaced no further apart by such inter-fold section of the perimetral wall than necessary to ensure that the users fingers primarily touch an outside portion and/or edges of each fold and avoid contact with an inner portion of each fold and wherein said overlapping folds include at least one hollow chamber between two overlapping portions of the perimetral wall.

2. The container according to claim 1, wherein the liner of the lamination consists of a heat-sealable material.

3. The container according to claim 1, wherein at least two portions of the perimetral wall are connected and/or sealed at the upper end of each fold.

4. The container according to claim 1, wherein at least two portions of the perimetral wall are connected and/or sealed at the upper and lower end of each fold.

5. The container according to claim 1, wherein the container is nestable with at least one other container.

6. The container according to claim 1, wherein a lower most part of the perimetral wall is supported by a bottom wall of a lower container when stacked.

7. The container according to claim 1, wherein an outer portion of each fold is approximately vertical.

8. The container according to claim 1 wherein a portion of said perimetral wall that contains the overlapping folds is arranged in a holding range of the container.

9. The container according to claim 1, wherein the hollow chamber is vacuumized or filled with gas.

10. A conical container having a bottom wall and a single perimetral wall with annular projections, wherein said perimetral wall is made of cardboard laminated at least on the inside, characterized in that said projections are formed as overlapping folds extending approximately parallel to the perimetral wall, wherein a plurality of said folds are arranged one above the other with an inter-fold section there between, each higher fold having a larger diameter than each lower fold and said folds spaced no further apart by such inter-fold section of the perimetral wall than necessary to ensure that the users fingers primarily touch an outside portion and/or edges of each fold and avoid contact with an inner portion of each fold and wherein at least one portion of the perimetral wall in an overlapping region of each fold is connected to at least one other portion of the wall and sealed.

* * * * *